US005575396A

United States Patent [19]

Smed

[11] Patent Number: 5,575,396

[45] Date of Patent: Nov. 19, 1996

[54] MODULAR STORAGE UNIT

[75] Inventor: Ole F. Smed, Calgary, Canada

[73] Assignee: R & D Group, Calgary, Canada

[21] Appl. No.: 359,274

[22] Filed: Dec. 16, 1994

[51] Int. Cl.[6] ..... A47F 5/00

[52] U.S. Cl. ..... 211/11; 211/55; 211/88; 211/194; D19/90; D19/92

[58] Field of Search ..... 211/55, 11, 10, 211/88, 194, 56, 126, 128; D19/86, 90, 92

[56] References Cited

U.S. PATENT DOCUMENTS

| | | | |
|---|---|---|---|
| D. 361,349 | 8/1995 | Brussing | D19/90 |
| 2,909,287 | 10/1959 | Galassi | 211/55 |
| 3,515,283 | 6/1970 | Poteat | 211/55 |
| 4,083,456 | 4/1978 | Genn et al. | 211/55 |
| 4,162,014 | 7/1979 | Bobrick | 211/126 X |
| 4,588,094 | 5/1986 | Evans . | |
| 4,871,218 | 10/1989 | Swinson | 211/55 X |
| 4,898,354 | 2/1990 | Whittington et al. | 211/88 X |
| 5,016,760 | 5/1991 | Mayo . | |
| 5,085,328 | 2/1992 | Evenson | 211/55 |
| 5,184,737 | 2/1993 | Hardy | 211/55 |
| 5,191,985 | 3/1993 | Licari . | |
| 5,222,609 | 6/1993 | Eaton | 211/55 |
| 5,344,030 | 9/1994 | Evenson . | |

FOREIGN PATENT DOCUMENTS

| | | |
|---|---|---|
| 2638954 | 5/1990 | France . |
| 8808344 | 8/1988 | Germany . |
| 9112506 | 11/1991 | Germany . |
| 8900509 | 1/1989 | United Kingdom . |

*Primary Examiner*—Robert W. Gibson, Jr.
*Attorney, Agent, or Firm*—Hardaway Law Firm, P.A.

[57] ABSTRACT

A multi-tray storage unit that allows for individual trays to be combined in a number of configurations is disclosed. The storage unit may be stood upright or hung from a wall, using various components, many of which are interchangeable, to make maximum use of available space.

19 Claims, 9 Drawing Sheets

MODULAR STORAGE UNIT

BACKGROUND OF THE INVENTION

Storing documents or the like in such a manner as to allow for maximum flexibility with an efficient use of available space is a laudable goal. Typically, stackable trays have only one way of being stacked. For example, with in/out boxes, the trays will be stacked such that all the tray entrances overlie each other. This makes grasping documents from any tray other than the topmost one difficult. Furthermore, these types of trays lack the ability to be hung from a wall or placed in a drawer or even made to assume a stepped or inclined tray configuration.

Furthermore, various types of hung file trays are known. For example, in U.S. Pat. No. 4,588,094, to Evans, a wall mounted file tray is shown. In this patent, a large number of holes must be made in the wall because each tray is supported by a fastener of some type inserted into the wall. When this filing tray system is taken down and moved, substantial wall repair will be required. Furthermore, the file tray of this patent does not allow for more than one configuration, nor use in a horizontal configuration and therefore lacks substantial flexibility of use.

U.S. Pat. No. 5,016,760, to Mayo, each tray can be collapsed for storage and shipping purposes. However, the file tray of this patent does not allow for more than one configuration, nor use in a horizontal configuration and therefore lacks substantial flexibility of use. Furthermore it is not easily possible to vary the number of trays.

Finally, there is U.S. Pat. No. 5,344,030, to Evenson, in which, due to the nesting configuration of the trays, the available space for file storage is diminished. Furthermore, the file tray of this patent does not allow for more than one configuration, nor use in a horizontal configuration and therefore lacks substantial flexibility of use.

Accordingly, there is room for improvement within the art.

OBJECTS OF THE INVENTION

It is thus an object of the invention to provide a modular storage unit made up of trays that may be joined together in various configurations.

It is yet another object of the invention to provide a modular storage unit in which a varying number of identical trays may be connected together.

It is yet another object of the invention to provide a modular storage unit that makes efficient use out of available space.

It is yet another object of the invention to provide a modular storage unit that may be either hung on a vertical surface or stood on a horizontal surface.

These and other objects of the invention are achieved by a modular storage unit having at least one tray comprising: a back wall having front and back surfaces; bottom and side walls extending outwardly from the front surface of the back wall; a bottom lip extending upwardly from the bottom wall; side lips extending inwardly from the side walls; wherein the walls and the lips define a storage area; a first connector on each side of the lips; and two second connectors on the back surface of the back wall.

DETAILED DESCRIPTION

It has been found that a modular storage unit constructed according to the invention, achieves a more flexible storage unit that makes effective use of available space.

Figure 1A:
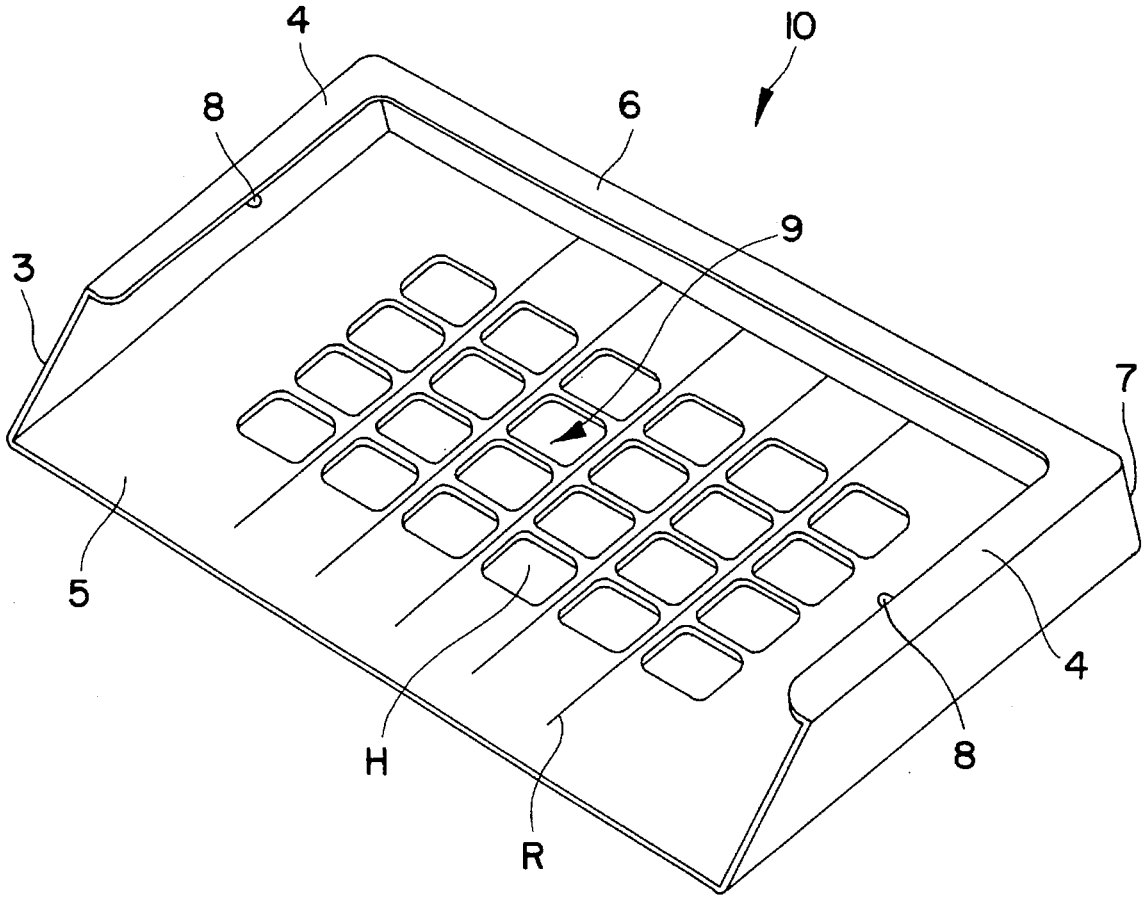
FIGS. 1A, 1B, and 1C are top perspective, bottom perspective, and side views, respectively, of an individual tray for use in the modular storage unit according to the invention.

The heart of the modular storage unit is a tray 10, shown in FIGS. 1A (top) and 1B (bottom). Tray 10 generally comprises a back wall 5, side walls 3 and bottom (or rear, depending upon upright or supine orientation) wall 7. Side walls 3 and bottom wall 7 extend out of back wall 5, preferably, in a direction perpendicular to back wall 5. Side lips 4 extend inwardly (i.e., towards a center of tray 5) from side walls 3. Bottom lip 6 extends upwardly (i.e., also towards a center of tray 5) from bottom wall 7. Each lip surface should be generally parallel to back wall 5. The various walls and lips define a storage area 9 for documents or the like. While in FIG. 1A, back wall 5 is shown as having a series of holes H and raised portions R, the precise structure of back wall 5 is conventional except as will be described below.

Figure 2A:
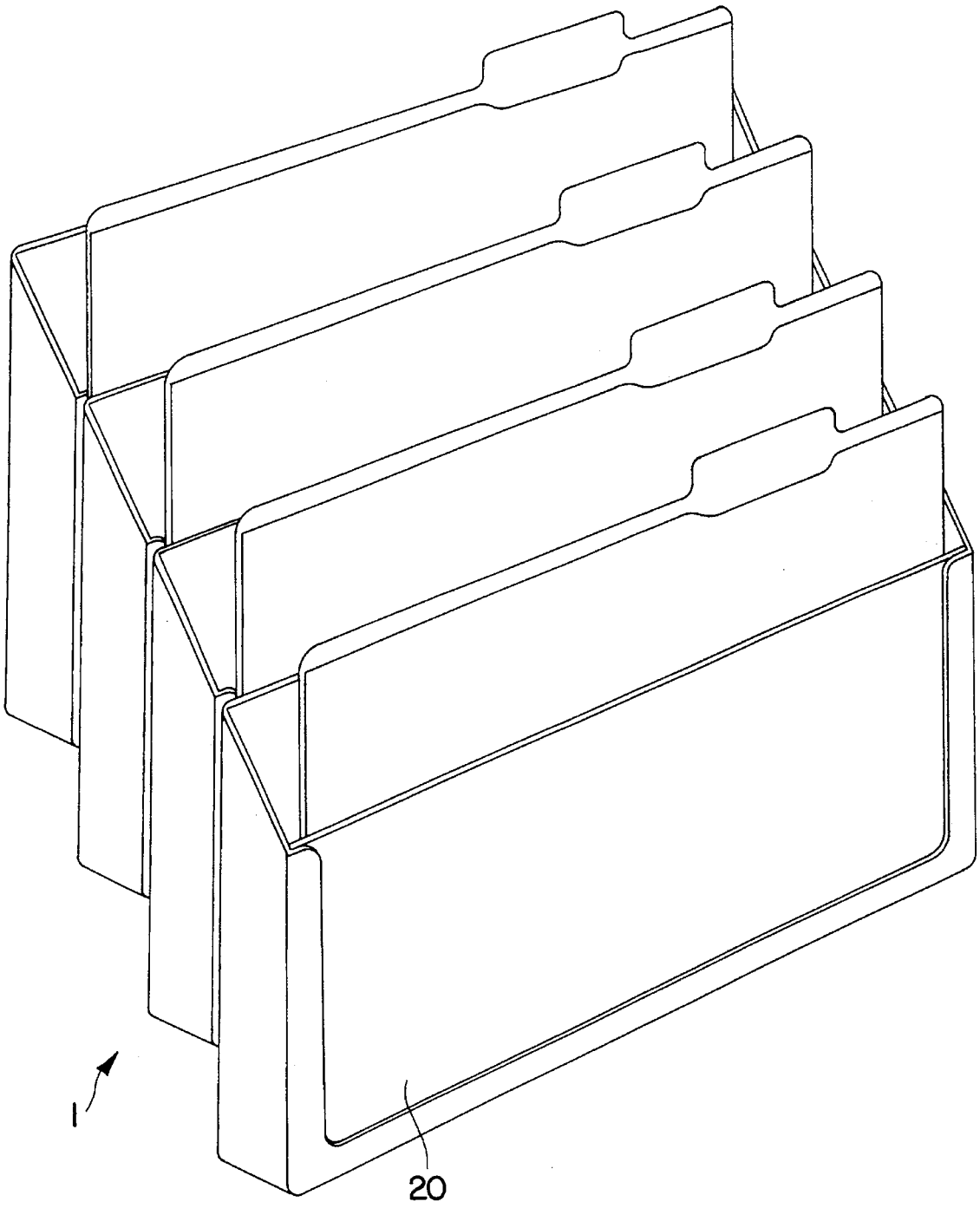
FIGS. 2A and 2B are two views of alternative configurations of a group of rays according to the invention.

The novelty of tray 10 lies in its adaptability to be joined together with other identical trays to form a modular, multi-tray storage unit which may be hung or stood on a surface. In either arrangement, tray 10 of any multi-tray unit to be described below, will preferably have a face plate 20 (FIG. 2A) to prevent any documents or the like from falling out of storage area 9.

To join together a number of trays, a novel connecting structure has been developed. That structure starts with each side lip 4 having a tab 8 molded or mounted thereon. Tabs 8, which are preferably semi-circular, are meant to mate with corresponding mounting structures found on the bottom a subsequent tray.

Figure 1B:
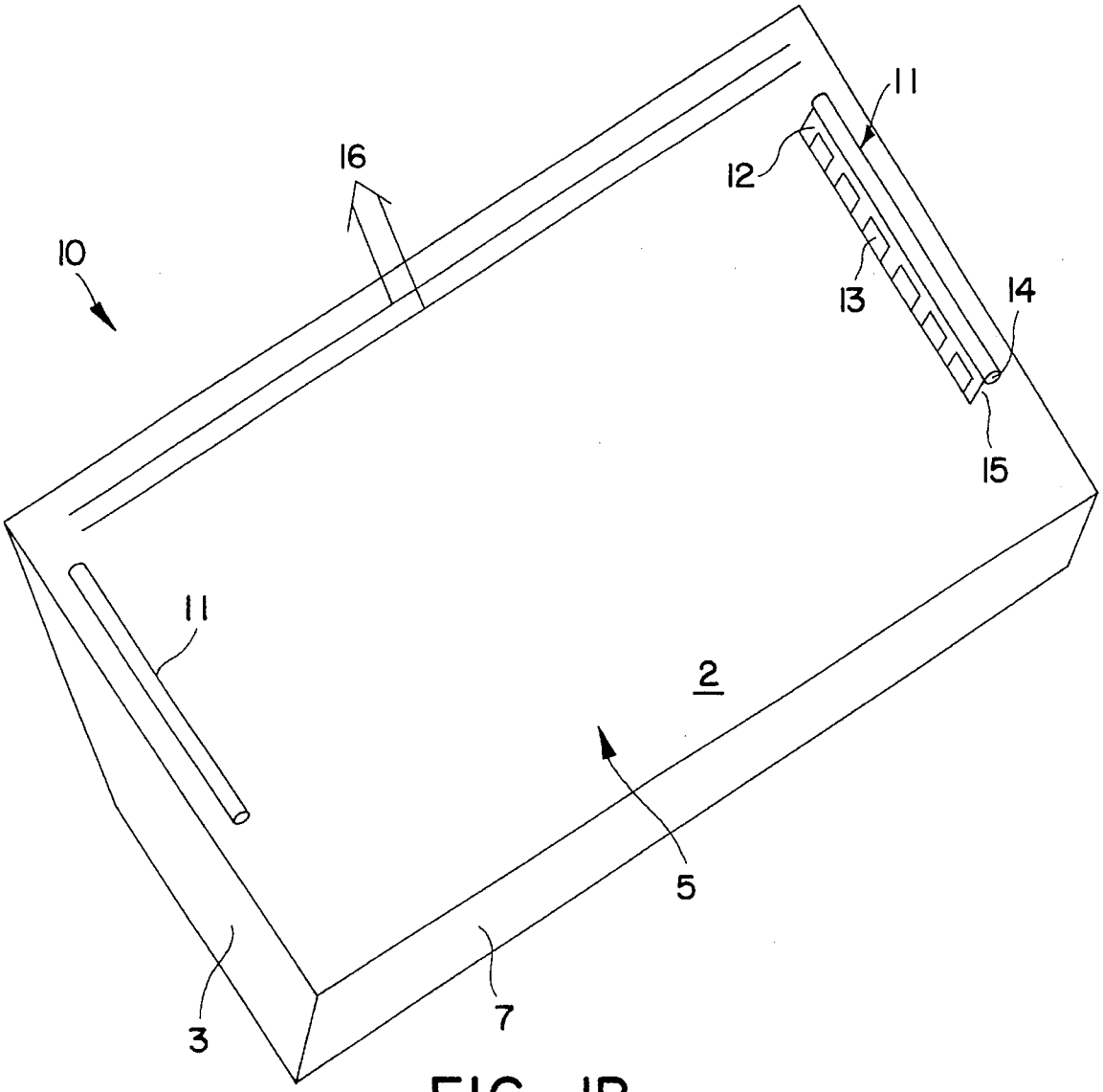
Figure 1C:
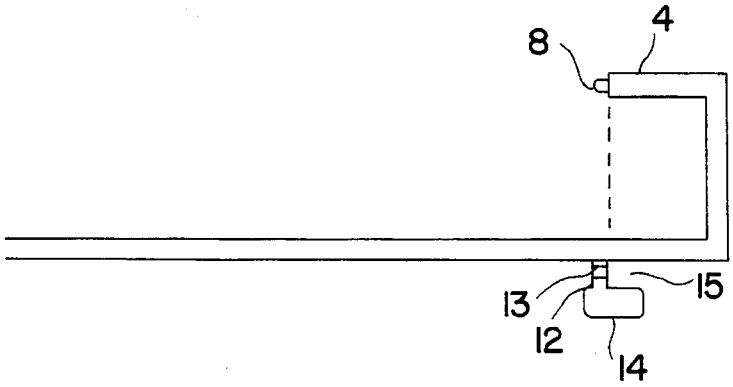

Two tracks 11 are mounted on back surface 2 of back wall 5. Each track 11 is spaced toward the sides of tray 10 at a position that will be described later. Each track 11 comprises an elongated raised portion 12 topped with an elongated ridge 14. Ridge 14 extends generally perpendicular to raised portion 12, in a direction generally parallel to back wall 5 and towards side wall 3, thus overhanging raised portion 12, forming gap 15. Gap 15 will have a height substantially equal to the thickness of side lips 4 in the area of tab 8 (although it is conceived that entire side lip 4 will have the same thickness). Each track 11 is spaced from side walls 3 so as to cause elongated portions 12, and thus gaps 15, to correspond with tabs 8 and the outermost edges of side lips 4 (FIG. 1C). Furthermore, a series of holes 13 extends along the length of each raised portion 12 and extends entirely therethrough. However, it is also conceived that holes 13 may simply be indentations in raised portion 12 on its side facing gap 15. Finally, back surface 2 of back wall 5 has generally parallel protuberances 16 that add structural rigidity to the tray and allow an upright (perpendicular to the bottom of the drawer) drawer divider (not shown) to rest therebetween when the tray is used in a drawer as will be discussed with respect to FIG. 3 below.

Figure 2B:
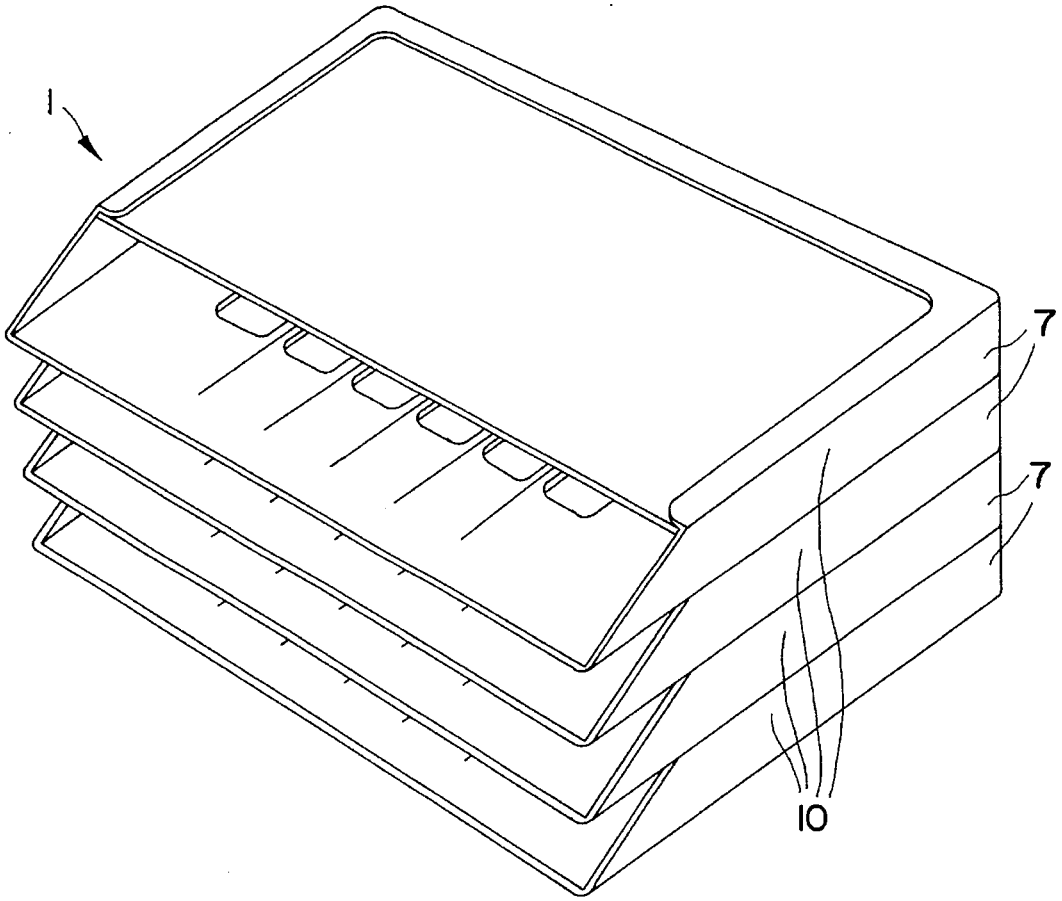

The structure of an individual tray 10 having been described, it will now be described how two or more trays may be joined together to form a modular, multi-tray storage unit 1. Tabs 8 and side walls 4 of a first tray are slid through gaps 15 of a second or subsequent tray. This sliding continues until tabs 8 of the first tray are friction fitted/locked into the desired holes 13 or indentations of the second tray. By "desired", it is meant that holes 13 allow for adjustment of the longitudinal spacing between trays to attain the specific spacing required for a particular application. For example, in FIG. 2A it is shown how the trays 10 can be connected together to form a step-like or inclined storage unit 1. In FIG. 2B, it is shown how the trays 10 can be connected together to form a storage unit 1 in which the leading edges of all trays are flush because all back walls 7 are positioned along a plane and not spaced from each other. The particular tray configuration can be easily varied by applying opposing forces to the leading (or the leading and trailing) edges of the two trays until tabs 8 are forced out of holes 13, allowing for relative movement between the trays until tabs 8 enter the next set of holes 13. Typically, to allow for some give in the structure of the tray such that the tabs 8 can be removed from holes 13, yet retaining structural stiffness to prevent undesired relative movement between tabs 8 and holes 13, trays 10 will preferably be made from injection molded polystyrene.

Figure 3:
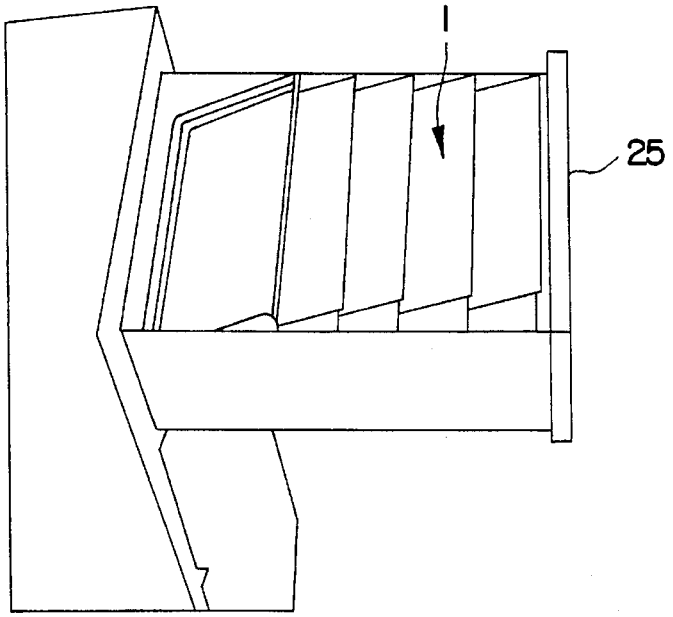
FIG. 3 is a perspective view of a group of trays according to the invention placed in a drawer.

Having now described how a multi-tray storage unit 1 may be formed, description will be made as to how such a unit 1 may be stored at a work surface. First, as shown in FIG. 3, unit 1 can be merely lied on its lowermost tray 10 within a desk drawer 25 (unit 1 in configuration shown in FIG. 2B). Because of the spacing between entrances to adjacent trays, all trays are equally accessible. As described above, an upright drawer divider (not shown) is placed between protuberances 16 on the back of the uppermost tray. This drawer divider, in combination with the back of the uppermost tray and its protuberances, will cause the modular unit not to tip over.

Figure 4A:
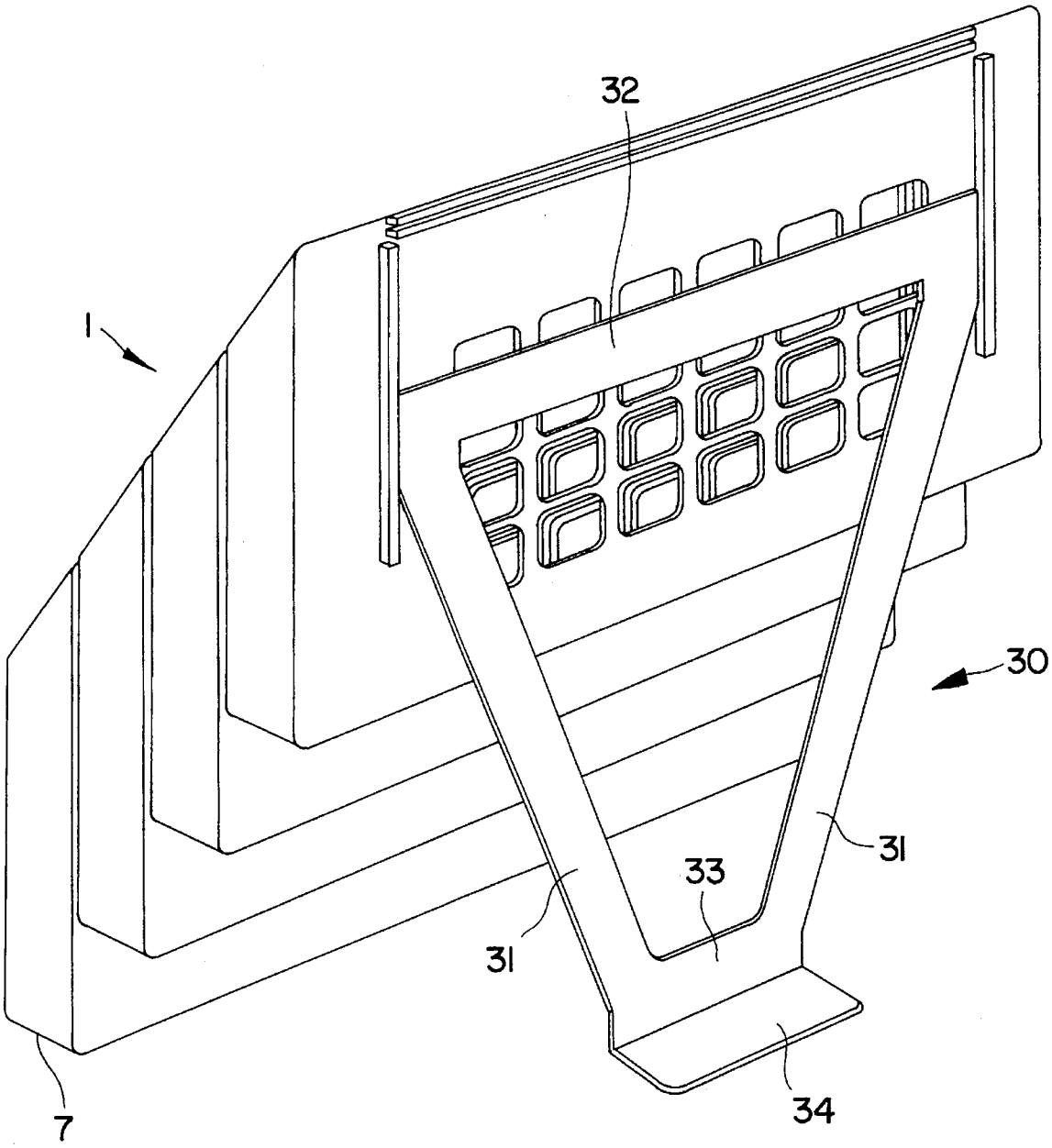
FIG. 4A is a perspective view depicting a group of trays according to the invention standing a horizontal surface with the aid of a stand.
Figure 4B:
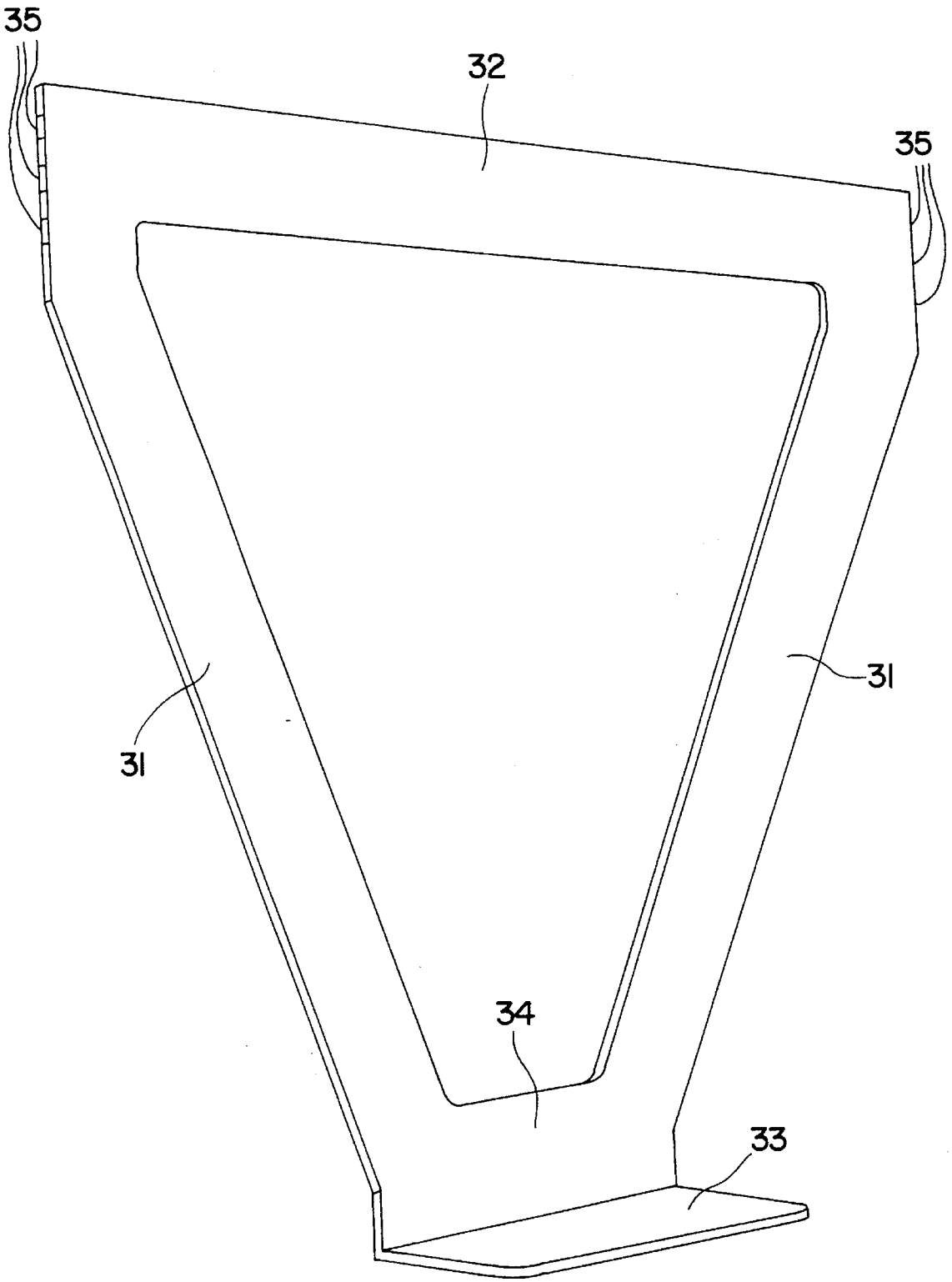
FIG. 4B is a perspective view isolating the stand shown in FIG. 4A.

FIGS. 4A and 4B illustrate how standing inclined unit 1 may be made using stand 30 (which can also be a hanger as will be described below). Stand 30 has upper 32 and lower 33 horizontal bars. Bars 32, 33 are connected by one or more legs 31. When bars 32 and 33 are parallel and there are two legs 31, stand 30 assumes a generally trapezoidal shape. Lower horizontal bar 33 has a base 34 extending perpendicularly from its lower edge. Additionally, tabs 35 (FIG. 4B) extend from either end of upper horizontal bar 32. While these tabs are shown as rectangular, they may be semicircular like tabs 8. To use the stand, as shown in FIG. 4A, tabs 35 will be inserted in holes 13 of elongated portion 12 (FIG. 1B) and the entire unit 1 stands on base 34 and bottom wall 7 of the lowermost tray in the unit 1. In this configuration, because stand 30 is not placed into gap 15, the thickness of upper horizontal bar 32 is not as important as the fact that tabs 35 fit within holes 13.

Figure 5A:
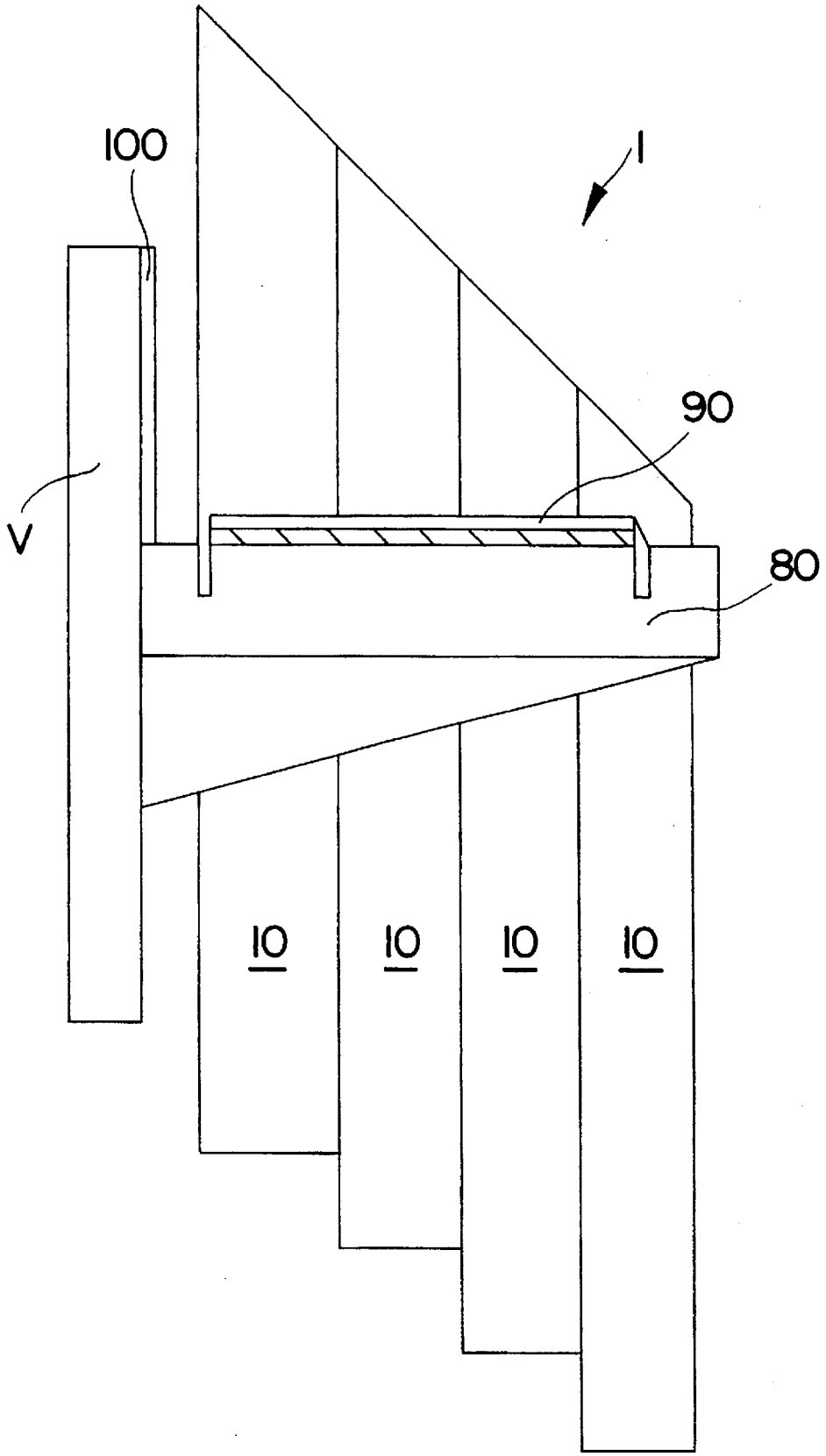
FIG. 5A is a perspective view depicting a group of trays according to the invention hung from a wall.
Figure 5B:
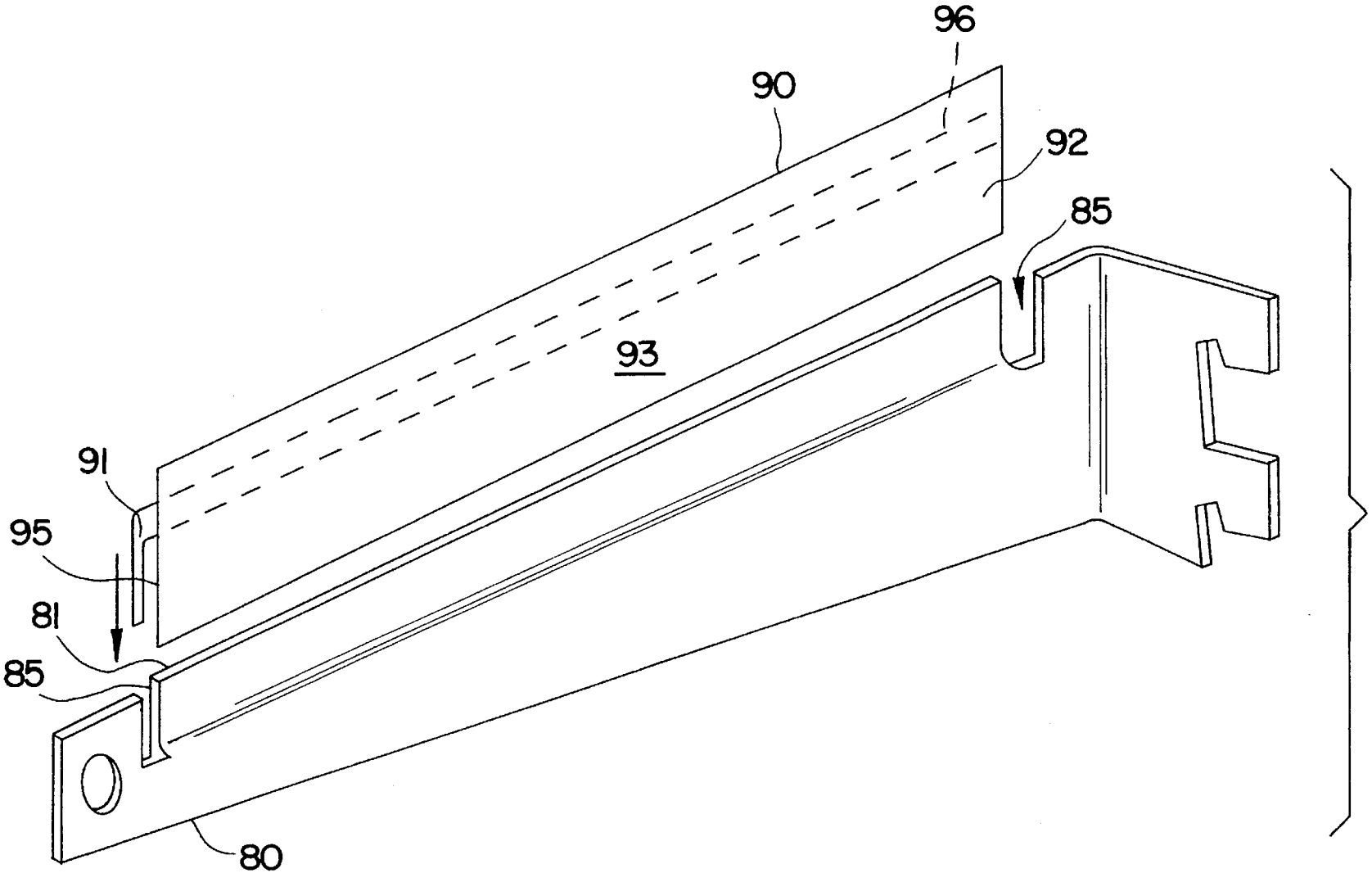
FIG. 5B is a perspective view isolating the hook and hanger strip shown in the arrangement of illustrated in FIG. 5A.

Multi-tray unit 1 can also be hung from a wall, door, panel, etc. There are at least three ways of doing this. First, as shown in FIGS. 5A and 5B, unit 1 can be hung from a vertical surface V by the use of two hooks 80 (only one of which is shown), inserted into conventional hook receiving hardware 100. In this arrangement, hanger clips 90 are attached to both sides of multi-tray storage unit 1, allowing unit 1 to be hung from hooks 80. FIG. 5B shows in detail hook 80 and hanger strip 90. Hook 80 is conventional except that it has a clip supporting portion 81 that is offset from the rest of the hook body and may have cut out portions 85. Hanger clip 90 has an inner wall 92 having adhesive backing 93, with a peel-off backing (not shown) thereon. Outer wall 96 has an overhanging portion 91 which defines a downwardly extending channel 95. In use, the backing is peeled off to expose the adhesive, hanger clips 90 are adhesively attached to both sides of unit 1, hooks 80 are positioned at the appropriate height, and unit 1 is positioned between hooks 80 such that downwardly extending channels 95 overlie clip supporting portion 81, thus allowing unit 1 to be hung.

Figure 6A:
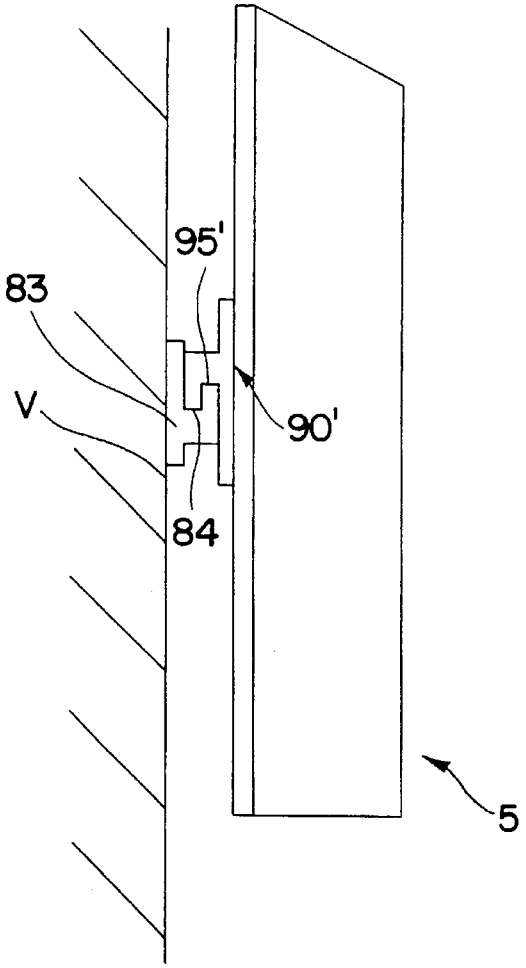
FIGS. 6A and 6B are perspective views of clips suitable for hanging a group of trays from a wall in an alternative arrangement.
Figure 6B:
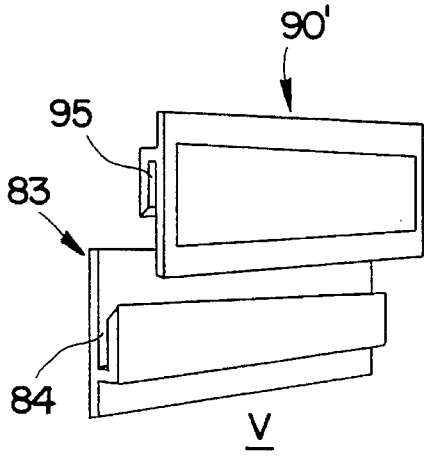

FIGS. 6A and 6B show a second way of hanging unit 1 (of which, only a back wall 15 of a last tray 10 is shown in FIG. 6A). Here a hanger clip 90', very similar to that described immediately above, is attached to back surface 2 of back wall 5. Clip 84, similar to that of clip 90', is hung in an inverted orientation with respect to clip 90' on a vertical surface V. The two clips respective channels are brought into contact with each other, whereby the two clips interlock and the unit 1 is hung from clip 84.

Figure 7:
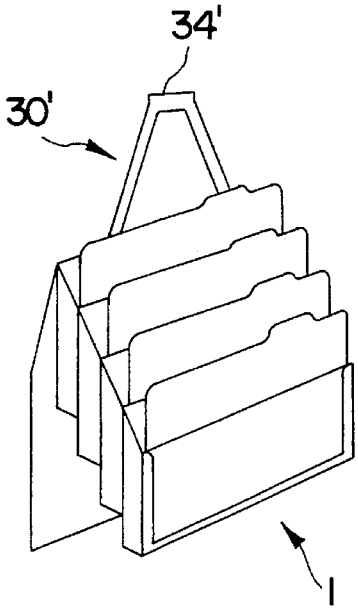
FIGS. 7 is a perspective view illustrating an alternative arrangement whereby a group of trays may be hung from a wall.

Finally, FIG. 7 shows yet a third way of hanging unit 1. In this FIG., stand 30 in inverted and becomes hanger 30'. What was base 34 now becomes overhang 34' which can be fit over the top of a door or panel, etc. Accordingly, unit 1 can be hung using hanger 30'.

It is thus seen how the modular storage unit according to the invention provides a storage unit made up of trays that may be joined together in various configurations. It is also seen how the modular storage unit according to the invention provides a storage unit that makes efficient use out of available space. Further, it is also seen how the modular storage unit according to the invention to provide a storage unit that may be either hung on a vertical surface or stood on a horizontal surface.

The above description is given in reference to a storage unit. However, it is understood that many variations are apparent to one of ordinary skill in the art from a reading of the above specification and such variations are within the spirit and scope of the instant invention as defined by the following appended claims.

That which is claimed:

1. A storage unit having at least one tray comprising:

a back wall having front and back surfaces;

bottom and side walls extending outwardly from said front surface of said back wall;

a bottom lip extending upwardly from said bottom wall;

side lips extending inwardly from said side walls;

wherein said walls and said lips define a storage area;

a first connector on each of said side lips; and two second connectors on said back surface of said back wall each of said two second connectors having multiple tab receiving portions such that a first tray can be connected to another tray to form a multi-tray unit having one of multiple configurations.

2. The storage unit according to claim 1, wherein said multi-tray unit comprises four trays.

3. A storage unit having at least one tray comprising:

a back wall having front and back surfaces;

bottom and side walls extending outwardly from said front surface of said back wall;

a bottom lip extending upwardly from said bottom wall;

side lips extending inwardly from said side walls;

wherein said walls and said lips define a storage area;

a first connector on each of said side lips;

two second connectors on said back surface of said back wall;

wherein each said first connector of a first tray is connected to one of said second connectors of another tray to form a modular multi-tray unit; and further wherein said first connector comprises tabs; and said second connector comprises a track, said track further comprising:

an elongated raised portion, said elongated raised portion having tab receiving portions along its length; and an elongated ridge portion, extending sidewardly out from said elongated raised portion to form a gap, said gap being of sufficient magnitude to receive a side lip and tab of said another tray;

wherein when said modular, multi-tray unit is formed, said tab and side lips of a first tray are positioned in the tab receiving portions and gap, respectively, of said track of said another tray.

4. The storage unit according to claim 3, wherein said tab receiving portions comprise holes.

5. The storage unit according to claim 1, wherein said tab receiving portions comprise holes.

6. The storage unit according to claim 4, wherein said tabs are semi-circular.

7. The storage unit according to claim 4, wherein each bottom wall of a tray of the modular, multi-tray unit is coincident with a bottom wall of another tray.

8. The storage unit according to claim 4, wherein each bottom wall of a tray of the modular, multi-tray unit is spaced from a bottom wall of another tray.

9. The storage unit according to claim 8, further comprising means for changing the spacing between said bottom walls to effect a change in a configuration of said storage unit.

10. The storage unit according to claim 9, wherein said modular multi-tray unit comprises four trays.

11. The storage unit according to claim 4, wherein said modular multi-tray unit stands.

12. The storage unit according to claim 11, wherein said standing multi-tray unit further comprises:

a stand member having upper and lower horizontal members connected by at least one leg having a base member, said stand member also having tabs thereon;

wherein said tabs of said stand are positioned within said holes of the last tray of said multi-tray unit.

13. The storage unit according to claim 11, wherein said stand of said standing modular multi-tray unit further comprises:

a trapezoidally shaped stand member having a base member at a bottom thereof, said stand member also having tabs thereon; and wherein said tabs of said stand are positioned within said holes of the last tray of said multi-tray unit.

14. The storage unit according to claim 8, wherein said multi-tray unit is positioned within a drawer.

15. The storage unit according to claim 8, wherein said multi-tray unit is hung on a vertical surface.

16. The storage unit according to claim 15, further comprising:

a first horizontal member having an upwardly extending channel fixedly attached to said vertical surface;

a second horizontal member having a downwardly extending channel fixedly attached to a back surface of said last tray of said multi-tray unit;

wherein by positioning said downwardly extending channel in said upwardly extending channel, said multi-tray unit is hung from said vertical surface.

17. The storage unit according to claim 16, wherein said first and second horizontal members are fixedly attached to their respective surfaces by adhesive.

18. The storage unit according to claim 15, further comprising:

a top hanger having upper and lower horizontal members connected by at least one leg having a horizontal support at a top thereof, said top hanger having tabs thereon;

wherein said tabs of said top hanger are positioned within said holes of the last tray of said multi-tray unit; and said horizontal support is placed over a top of a vertical surface to hang said multi-tray unit.

19. The storage unit according to claim 18, wherein said top hanger can be inverted to be used as a stand for the modular multi-tray unit.

* * * * *